United States Patent [19]

Bakewell

[11] 4,399,348

[45] Aug. 16, 1983

[54] THERMAL PRINT HEAD AND METHOD OF FABRICATION

[75] Inventor: Joseph J. Bakewell, Boxford, Mass.

[73] Assignee: Dynamics Research Corporation, Wilmington, Mass.

[21] Appl. No.: 265,978

[22] Filed: May 21, 1981

[51] Int. Cl.[3] ..... H05B 1/00

[52] U.S. Cl. ..... 219/216; 346/76 PH

[58] Field of Search ..... 346/76 PH, 1.1; 219/216; 400/120

[56] References Cited

U.S. PATENT DOCUMENTS

| | | | |
|---|---|---|---|
| 3,578,946 | 5/1971 | Colello | 346/76 PH X |
| 3,950,200 | 4/1976 | Muramoto et al. | 219/216 X |
| 4,030,408 | 6/1977 | Miwa | 219/216 X |
| 4,096,510 | 6/1978 | Arai et al. | 219/216 X |

*Primary Examiner*—G. Z. Rubinson
*Assistant Examiner*—W. J. Brady
*Attorney, Agent, or Firm*—Weingarten, Schurgin, Gagnebin & Hayes

[57] ABSTRACT

A high resolution thermal print head and method of fabrication is provided in which resistive elements are located at the edge of a dielectric support which functions as a spacer and is sandwiched between opposing substrates which carry vertically running electrodes on their inner faces. The electrodes extend to the edge of the spacer where they make electrical contact with opposing sides of the resistive elements. In one embodiment, the resistive elements are recessed into the edge of the spacer to minimize wear. The edge-on contact provided by the print head with the printing paper provides that all the supporting circuitry is orthogonal to the plane of the paper. In one embodiment, the spacer is provided with channels for coolant which is circulated immediately beneath the resistive elements. In another embodiment, the writing surface of the print head is ground down over opposing electrodes to expose the tops of the electrodes and to provide channels at the positions where resistive elements are to be placed, with resistive material deposited in the channels and then ground off to the desired head configuration. Only that portion of a resistive material lying between the exposed opposing electrodes is heated upon the application of power to the electrodes.

14 Claims, 7 Drawing Figures

THERMAL PRINT HEAD AND METHOD OF FABRICATION

FIELD OF INVENTION

This invention relates to thermal print heads and more particularly a high resolution element mounting structure and method of fabrication.

BACKGROUND OF THE INVENTION

Thermal print heads have been utilized in the past in which a row of resistive elements are driven to provide an alpha-numeric pattern on thermal print paper which is moved past the print head. In one common type print head a row of resistive elements is formed by patterned deposition on the top surface of a substrate, usually a printed circuit board. Connections to the resistive elements are made in the same plane as the top surface of the substrate, such that the print head is configured with both the resistive elements and the patterned conductors in the same plane. Since the print paper is transported immediately over the surface of the print head containing the resistive elements and printed circuit, contact to the resistive elements is somewhat difficult. Moreover, since the resistive elements are raised from the plane of the printed circuit board, there is a certain amount of wear associated with abrasion occasioned by the movement of the thermal print paper over the resistive elements. As to resolution, the resolution of the planar print head is limited by the density of the resistive elements, which is in turn, limited by the density of the interconnecting conductors or busses. Since the busses and the resistive elements occupy space in one plane, packing density is limited.

The limit to the resolution of an array of resistive elements is only partially associated with the density of the resistive elements. More importantly, the resolution is dependent upon the ability of the head to dissipate heat. While substrates have been devised which are relatively good thermal conductors, without active cooling, the resistive elements are cycled at relatively slow rates, and thus the resolution of such a planar array is limited.

SUMMARY OF THE INVENTION

In the subject invention the planar approach is discarded in favor of providing resistive elements at the edge of a rectangular thin central dielectric support member sandwiched between substrates which carry electrodes on the interior surfaces thereof. In this invention, the print head writing surface over which the thermal print paper travels includes the edge of the central support member and the edges of the opposing substrates, with the central support edge being recessed at spaced locations to receive the resistive elements. Cooling channels are provided immediately below the resistive elements through the central support member, and the entire thermal print head support structure is oriented orthogonal to the plane of the moving paper, rather than parallel to it. Connections are made to the electrodes carried on the internal surfaces of the opposing substrates through plated through holes at the bottoms of the substrates. Thus electrical connection can be made to the print head assembly at contact pads removed from the plane of the paper, thus facilitating the wiring of the print head.

The result of forming a print head in the above described manner is that it provides a means for presenting only the writing surface of the print head to the paper, with all supporting circuitry being orthogonal to both the paper and the writing surface. The recessing of the resistive elements within the central support member minimizes abrasive wear and the electrode structure provides a convenient means for addressing an array of resistive elements so as to permit closer element spacing which results in increased resolution. The utilization of localized cooling increases the achievable cycling rates and thus increases the resolution. The laminated edge-on structure also permits the fabrication of print heads with multiple rows of resistive elements, the elements of which may be offset from one row to the other to achieve overlap in the coverage of the elements.

More particularly, a thermal print head and method of fabrication is provided in which resistive elements are located at the edge of a thin rectangular dielectic support which functions as a spacer and is sandwiched between opposing substrates which carry vertically running electrodes on their inner faces. The electrodes extend to edge of the support spacer and make electrical contact at opposing sides of the resistive elements. In one embodiment, the resistive material is recessed into the edge of the support to minimize wear. In another embodiment, the support is provided with channels for coolant which is circulated immediately beneath the resistive elements, with the channels being completed or closed in by one or more of the opposing substrates. The use of through-hole technology permits connection of the electrodes carried on the interior surfaces of the substrates to contact pads on the exterior surface of the substrate, thereby providing ready accessibilty for the addressing of the high resolution row of resistive elements. Multiple rows of resistive elements are provided by duplicating the laminated structure, in which dielectric supports are sandwiched between opposing substrates in a stacked manner. In one embodiment, the edge of the dielectric support and the edges of the opposing substrates are ground down over opposing electrodes to expose the tops of the electrodes and to provide channels at the positions where resistive elements are to be placed, with resistive material deposited in the channels and then ground off to the desired head configuration. The result is that only that portion of the resistive material lying between the exposed opposing electrodes is heated upon the application of power to the electrodes.

BRIEF DESCRIPTION OF THE DRAWINGS

These and other features of the subject invention are described in detail hereinafter in connection with the drawings of which.

DETAILED DESCRIPTION

Figure 1:
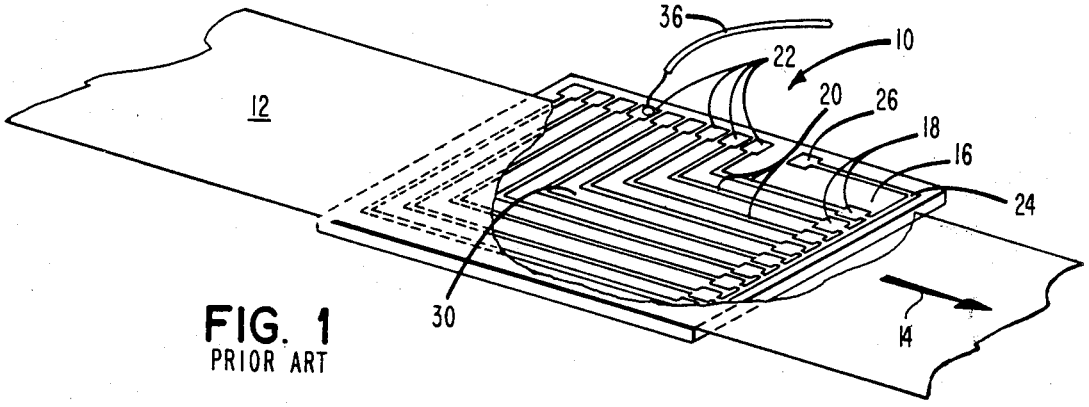
FIG. 1 PRIOR ART
FIG. 1 is a diagrammatic representation of a prior art planar thermal print head.
Figure 2:
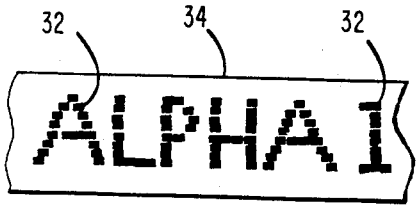
FIG. 2 is a diagrammatic representation of the type of alpha-numeric printing provided by the print head of FIG. 1.

Referring now to FIG. 1, a prior art planar thermal print head 10 is illustrated as being positioned immediately under a sheet 12 of commercially available thermal print paper which is driven so as to move in the direction of arrow 14 across the print head. Print head 10 is provided with a row 16 of resistive elements 18 which are connected by busses 20 to corresponding contact pads 22. A ground bus 24 is provided on a side of a resistive element oposite that to which bus 20 is connected, with the ground bus running to a contact pad 26. It will be appreciated that all of the elements of print head 10 are patterned on top surface 30 of a substrate or printed circuit board and that resistive elements 18 deposited over the interconnect busses project upwardly from surface 30 so as to contact sheet 12. In operation, power is applied to the contact pads to energize selected resistive elements which are then heated for providing a mark on the moving sheet. Depending on the indexing and the speed of movement of the sheet, as illustrated in FIG. 2, alpha-numeric characters 32 may be imprinted on a suitable thermal print paper 34.

As mentioned hereinbefore, there are several problems associated with the utilization of planar print heads including the density of the resistive elements which is in turn dependent upon the density of the interconnect busses. Moreover, there is the problem of abrasion of the resistive elements as the thermal print paper moves over the print head. There is also the problem of dissipating heat from deactivated resistive elements which limits the rate at which the array can be driven. There is also the problem of providing electrical leads to contact pads 22 because, as can be seen by the soldering of lead 36 to contact pad 22, this connection is in the same plane as the sheet and requires a considerable amount of lateral real estate for the planar thermal print head. Moreover, attaching the leads at or adjacent the thermal print paper is not only inconvenient from the packaging point of view, but also may result in the paper accidentaly coming into contact with the leads which results either in ripping of the paper or in damaging the connection of the leads.

Figure 3:
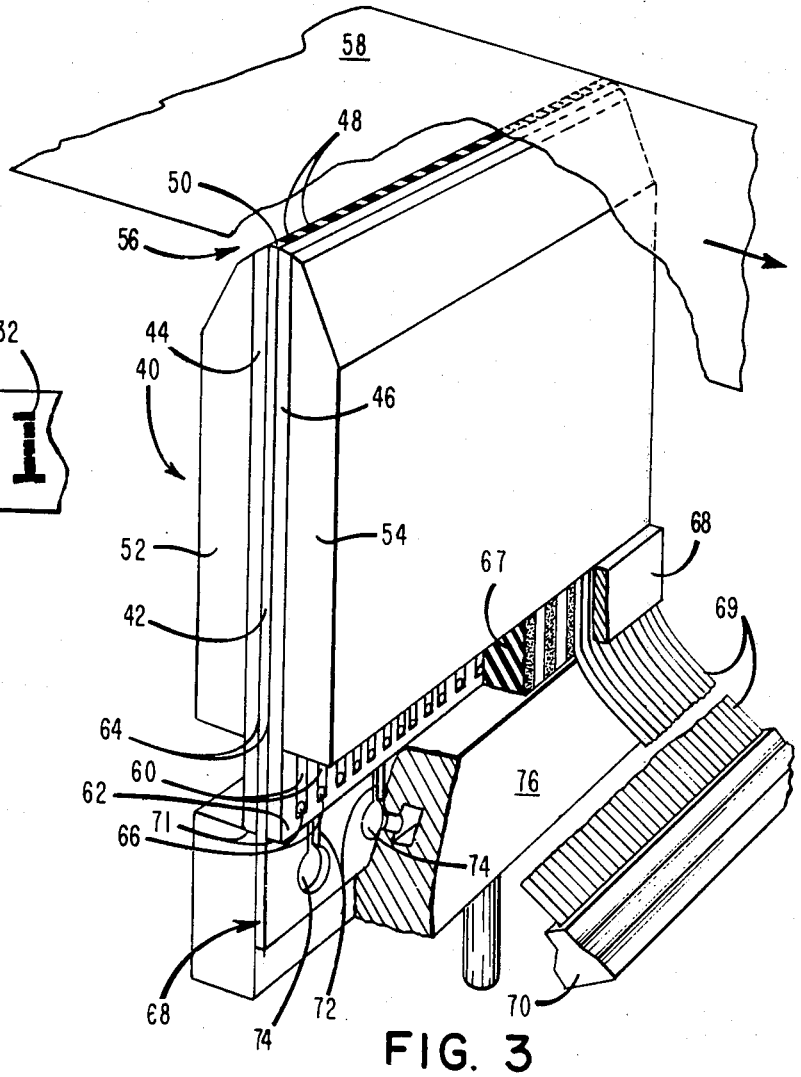
FIG. 3 is a perspective view of the subject print head relative to a moving sheet of thermal print paper, with the print paper cut away to illustrate the edge mounting of the resistive elements.

The problems associated with the prior art planar print head are solved by the configuration illustrated in FIG. 3, in which a vertically oriented print head 40 is provided with a central dielectric support or spacer 42, which is sandwiched between substrates 44 and 46. These substrates carry electrodes (not shown in this figure) for the activation of resistive elements 48 countersunk into edge 50 of support 42.

The sandwich structure is clamped together by end pieces 52 and 54. The top portion 56 of the head is rounded to form a smooth writing surface, with the resistive elements at the apex or topmost portion thereof. It will thus be seen that when a sheet 58 of thermal print paper is passed over the writing head, since the resistive elements are recessed within edge 50, wear of the resitive elements is minimized.

As illustrated at the bottom of substrates 44 and 46, a row of contact pads 60 is provided on the exterior surface 62 of the associated substrate. Contact pads 60 are connected to electrodes (not shown in this figure) carried on interior surfaces 64 of the substrates via through-holes 66. Thus, an electrode may be easily coupled via a conventional metal elastomeric connector 67 such as manufactured by Hulltronics, Inc. of Hatboro, Pa., held in place by a clamping bar 68 to a flexible cable 69, which in turn may be coupled to a standard connector clip 70.

Central dielectric support 42 is extended in the region 68 beyond ends 71 of substrates 44 and 46. In one embodiment, channels 72 are provided in the central support which communicate with inlet/outlet openings 74. Extension 68 is surrounded by a manifold structure 76 through which cooling fluid is provided. As will be described, channel 72 extends to the region immediately below resistive elements 48, thereby to provide efficient heat transfer from these elements when fluid is pumped through the channel.

In operation, selected resistive elements of head 40 are driven such that the selected element heats up, thereby to provide marks on the aforementioned thermal print paper. The entire head is oriented orthogonal to the plane of the moving thermal print paper and thus all connections electrical, mechanical, and otherwise, are made to the head at some distance from the thermal print paper. This provides for convenient packaging, and both electrical and fluid connection to the head.

In the embodiment illustrated, cooling channels are provided in the central support so that the speed at which they may be actuated is increased over that associated with the aforementioned planar thermal print head.

Figure 4:
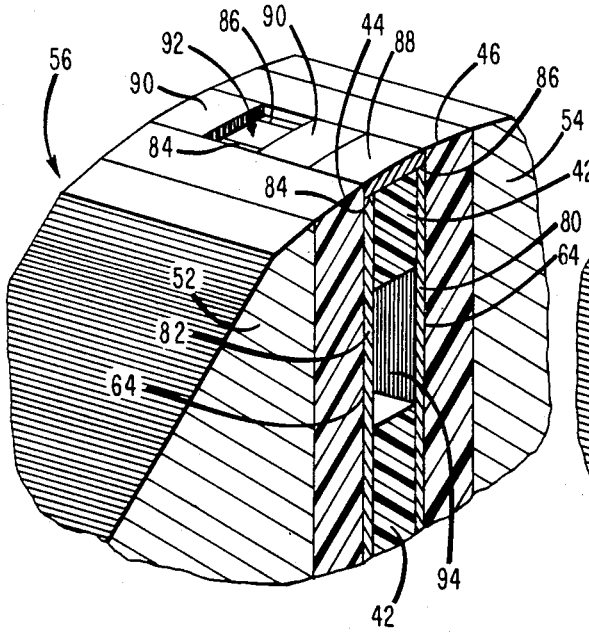
FIG. 4 is a perspective and cross-sectional illustration of the fabrication of the print head of FIG. 3 illustrating a coolant channel and the provision of recessed resistive elements.

Referring now to FIG. 4, portion 56 of print head 40 of FIG. 3 is illustrated in FIG. 4, in which like elements are provided with like reference characters. Here, dielectric spacer or support 42 is sandwiched between substrates 44 and 46. Electrodes 80 and 82 are positioned on interior surfaces 64 of their respective substrates such that ends 84 and 86 extend to and contact opposite sides of a recessed resistive element 88. Electrical power may thus be applied across a resistive element to cause it to heat up. Note that a portion 90 of dielectric spacer 42 extends up between adjacent resistive elements such that resistive material may be deposited in an aperture 92 therebetween. As illustrated, a channel 94 is provided in dielectic spacer 42 so to permit the flow of cooling fluid immediately beneath the resistive elements.

Figure 5:
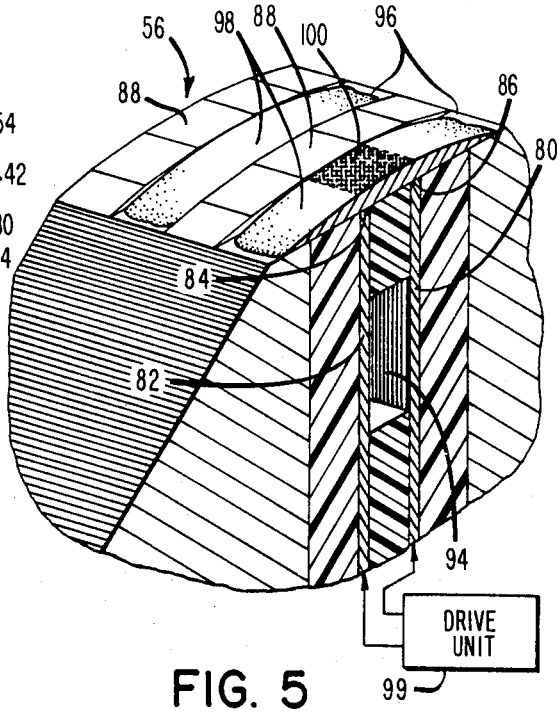
FIG. 5 is a perspective and cross-sectional illustration of the print head of FIG. 3 illustrating a method of channeling the print head edge and the provision of resistive material within the channels.

Referring now to FIG. 5, in which like elements are provided like reference characters with respect to FIG. 4, the resistive material, instead of being deposited in apertures recessed in the end of the dielectric support, may be located at the edge of the spacer by initially channeling or grooving writing head 56 as illustrated by channels or grooves 96, which channeling or grooving exposes top portions 84 and 86 of electrodes 82 and 84. Resistive material 98 is then squeegeed or deposited within the channels and the writing head 56 then lapped off as desired.

Upon the application of power to electrodes 82 and 84, only that portion of resistive material 98 between opposing electrodes is heated such that the heated portion corresponds to the cross-hatched portion 100.

Power for the electrodes may be provided as illustrated by drive unit 99.

Figure 6:
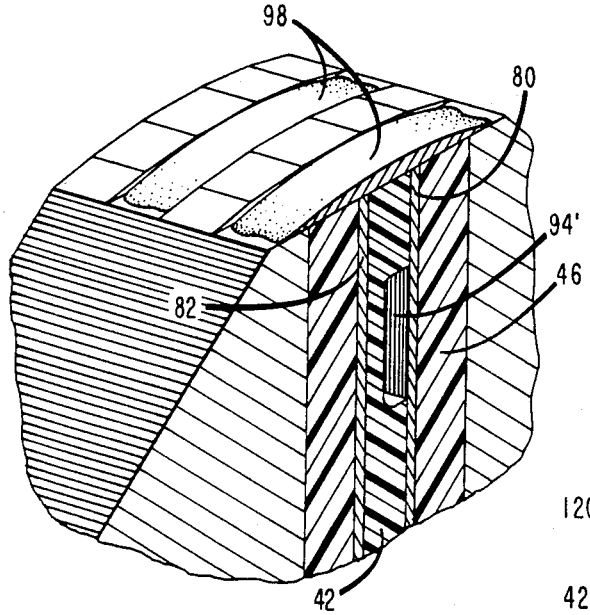
FIG. 6 is a perspective and cross-sectional illustration of the print head of FIG. 3 illustrating a half-channeled dielectric support in which the coolant channel is only exposed to one side of the support; and, FIG. 7 is a perspective and cross-sectional illustration of a portion of the thermal print head of FIG. 3, illustrating the provision of coolant channels in the central support and the through-hole structure which provides for external connection of the print head.

Referring to FIG. 6, dielectric spacer 42, instead of being provided with the channel illustrated in FIGS. 4 and 5, may be provided with a half channel 94' which is exposed only to substrate 46 and the electrodes carried thereon. This half channel 94' provides for sufficient cooling of the associated resistive elements, and as illustrated in FIG. 7 may be easily completed by one substrate.

Figure 7:
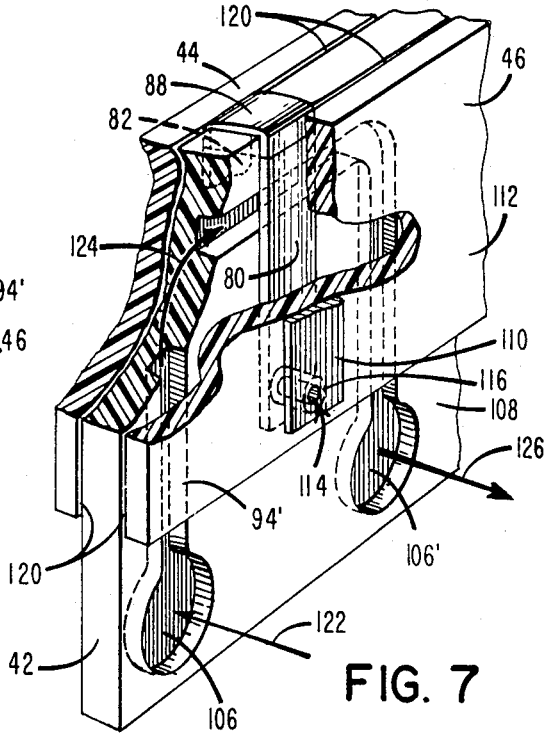

Referring now to FIG. 7, dielectric support 42 is provided with channels 94' which communicate with openings 106 at base 108 of central dielectic support 42. Substrate 44 is positioned and adhesively attached to the far side of support 42, whereas substrate 46 is attached adhesively to the near side of support 42.

The sandwich structure includes resistive element 88 positioned over electrodes 80 and 82, with electrodes carried on the interior surfaces of the corresponding substrates. As illustrated, electrode 80 is elongated and extends towards the bottom of substrate 46 where it is electrically connected to a contact pad 110 patterned onto the exterior surface 112 of substrate 46 by a through-hole connection generally indicated at 114, in which a plated through hole 116 is utilized as the electrical conduit between electrode 80 and contact pad 110.

It will be appreciated that channels 94' are completed by the interior surface of substrate 46. Since electrode 80 is patterned on to the interior surface and has a finite thickness, adhesive is applied on the interior surface of substrate 46 so as to fill in the space required by the thickness of the electrodes. This may be accomplished by selective adhesive patterning or may be accomplished by conventional potting techniques such that the spaces 120 between the central support and the adjacent substrate are filled with material. In an alternative embodiment, (not shown) the electrodes may be either recessed into the substrates or into the dielectic central support. Thus, when the central support is sandwiched between the substrates, the substrates are flush with the exterior surfaces of the central support so that no filler material need be used. However, since the electrodes are generally on the order of one mil, merely applying adhesive over all internal surfaces of the substrates not occupied by electrodes, suffices for a fluid tight seal whereby channels 94' may be made fluid tight.

In operation, fluid is introduced as indicated by arrow 122 into opening 106 from whence it travels upwardly through channel 94' and circulates as illustrated by arrow 124 through the U-shaped channel and out a second opening 106' as illustrated by arrow 126. Connection of fluid conducts to openings 106 and 106' is accomplished as illustrated in connection with FIG. 3 by the use of conventional manifolding techniques.

Having above indicated a preferred embodiment of the present invention, it will occur to those skilled in the art that modifications and alternatives can be practiced within the spririt of the invention. It is accordingly intended to define the scope of the invention only as indicated in the following claims.

What is claimed is:

1. A thermal print head comprising:

a pair of opposing substrates having top edges in one plane and a dielectric spacer sandwiched therebetween to produce a sandwiched structure extended in one direction, said dielectric spacer having recesses at the edge associated with the top edges of said opposed substrates;

resistive material located within said recesses to a level flush with the top edges of said opposing substrates thereby to form recessed thermal print elements;

means for applying power to selected thermal print elements; and wherein said spacer includes at least one channel running beneath said recesses, and further including means for flowing fluid through said channel for the cooling of said thermal print elements.

2. The thermal print head of claim 1, wherein said power applying means includes electrodes carried on the interior surfaces of said substrates, said electrodes extending at least to said recesses and having portions exposed therein, said resistive material contacting said exposed portions to provide a unitary structure in which contact is made to the thermal print elements without regard to registration of the element and the associated electrodes, a pair of said electrodes determining the active dimensions of the associated thermal print element.

3. The thermal print head of claim 2, wherein said substrates have contact pads on the exterior surfaces thereof and through hole means for connecting predetermined contact pads to predetermined electrodes through the corresponding substrate.

4. The thermal print head of claim 1, wherein a portion of said spacer extends beneath the lower edge of at least one of said substrates, and wherein the ends of said channel are exposed at said extended portion, said spacer including openings communicating with the ends of said channel, and further including manifold means at said extended position having fluid channels communicating with said openings.

5. The thermal print head of claim 1, and further including thermal print paper adapted to be driven past said thermal print elements in a direction perpendicular to the direction of extension of said sandwiched structure.

6. The thermal print head of claim 1, wherein each of said recesses includes a groove through adjacent edges of said substrates and spacer, said resistive material being located in said grooves.

7. The thermal print head of claim 2, wherein each of said recesses includes a groove through adjacent edges of said substrates and spacer, said resistive material being located in said grooves, with only the portion of said resistive material between opposing electrodes being heated by the application of power to said opposing electrodes.

8. A thermal print head comprising:

a dielectric member having flat sides and a top edge, said top edge having a recess in at least one location;

first and second substrates positioned against opposite sides of said dielectric member to provide a sandwiched construction, each substrate being flat and having a top edge adjacent the top edge of said dielectric member, each substrate including an electrically conductive buss carried on the surface thereof adjacent said dielectric member, the busses carried on opposing surfaces of said first and second substrates extending to opposing points within said recess;

resistive material within said at least one recess of said sandwiched dielectric member contacting said opposing busses at opposite sides of said resistive material, said resistive material formed such that the top surface of the resistive material is flush with the top edges of said first and second substrates; and means for applying power to said opposing busses.

9. A method of completing the fabrication of a thermal print head having a dielectric support spacer sandwiched between and abutting confronting substrates, wherein the dielectric support spacer has an edge at which are to be located thermal resistive elements, and wherein said substrates each have electrodes extending to the edges of the substrates adjacent the edge of the spacer which is to carry the thermal resistive elements and formed on the inside surface thereof, comprising the steps of:

channeling the edges of the sandwiched spacer and substrates at the locations at which resistive elements are to be provided so as to expose the tops of opposing electrodes formed on respective ones of said confronting substrates in the bottoms of corresponding channels; and depositing resistive material in the channels such that the resistive material contacts the exposed tops of opposing electrodes.

10. The method of claim 9, and further including the step of lapping the top surfaces of the resistive material and the edges of the spacer and substrates adjacent the resistive material to a predetermined flush configuration.

11. A thermal print head comprising:

a pair of opposing substrates and a dielectric spacer sandwiched therebetween to produce a sandwiched structure extended in one direction, said dielectric spacer having recesses at one edge;

resistive material located within the recesses thereby to form thermal print elements;

means for applying power to selected thermal print elements; and, means for providing a flowing fluid in said sandwiched structure beneath said thermal print elements.

12. A print head for a thermal printer, comprising:

a planar dielectic support member having a support member edge provided with a plurality of transversely extending recesses formed therealong at spaced-apart points;

a resistive material disposed in individual ones of said spaced-apart transversely extending recesses for providing a like plurality of resistive print head elements;

a first planar substrate having first and second surfaces and a first substrate edge;

a first metalization pattern disposed on said first surface of said first substrate for providing a like plurality of spaced-apart conductive paths each terminating at spaced-apart points at least proximate said first substrate edge;

a second planar substrate having third and fourth surfaces and a second substrate edge;

a second metalization pattern disposed on said third surface of said second substrate for providing a like plurality of spaced-apart conductive paths each terminating at spaced-apart points at least proximate said second substrate edge;

means for supporting said planar dielectric support member between and abutting said first and said second substrates such that confronting ones of said conductive paths on said first and said third surfaces of said first and said second substrates are electrically connected to a corresponding one of said resistive print head elements provided in said recesses of said dielectric support member; and means coupled to said second and said fourth surfaces of said first and said second substrates for providing external electrical connection to corresponding ones of said conductive paths respectively on said first and said third surfaces of said first and said second substrates.

13. The print head for a thermal printer of claim 12, wherein said dielectric support member further includes a cooling channel formed therein below said support member edge and extending in a line generally parallel thereto.

14. The print head for a thermal printer of claim 12, wherein said first and said second substrates further include confronting spaced-apart transversely extending channels formed along said first substrate edge and said second substrate edge respectively, and wherein said resistive material is further disposed in said first and said second substrate channels.

* * * * *